US006618955B2

(12) United States Patent
Rice

(10) Patent No.: US 6,618,955 B2
(45) Date of Patent: Sep. 16, 2003

(54) TEMPLATE FOR ARRANGING AND HANGING MULTIPLE WALL HANGINGS

(76) Inventor: Sandra E. Rice, 7210 Walden La., Darien, IL (US) 60561

( * ) Notice: Subject to any disclaimer, the term of this patent is extended or adjusted under 35 U.S.C. 154(b) by 0 days.

(21) Appl. No.: 10/078,096

(22) Filed: Feb. 19, 2002

(65) Prior Publication Data

US 2003/0154614 A1 Aug. 21, 2003

(51) Int. Cl.[7] ..... G01D 21/00
(52) U.S. Cl. ..... 33/613; 33/1 B; 33/1 G
(58) Field of Search ..... 33/613, 1 B, 1 G, 33/1 AA, 645, 562, 563, 566

(56) References Cited

U.S. PATENT DOCUMENTS 1,205,879 A * 11/1916 Felten ..... 33/1 B
2,610,413 A * 9/1952 Dasey ..... 33/562
4,827,621 A * 5/1989 Borsuk ..... 33/1 B
4,860,456 A * 8/1989 Arnao ..... 33/1 B
5,076,612 A * 12/1991 Nirmel ..... 33/1 B
6,449,863 B1 * 9/2002 Voorhees ..... 33/613

* cited by examiner

*Primary Examiner*—Christopher W. Fulton
(74) *Attorney, Agent, or Firm*—Gregory B. Beggs

(57) ABSTRACT

A template for hanging a group of two or more pictures or other wall decorations is disclosed which is conformable to the size of the area to be covered by the hangings and carries the locations of the hangings and hooks therefor onto the chosen area. A method for arranging two or more wall hangings for a chosen area of a wall while the hangings are disposed on a horizontal surface and thereafter transferring the arrangement to the vertical surface of the wall is also disclosed.

16 Claims, 3 Drawing Sheets

TEMPLATE FOR ARRANGING AND HANGING MULTIPLE WALL HANGINGS

This invention relates to templates for hanging pictures or other decorations on a vertical display area such as a living room wall, a hallway wall, or a wall area in an office. More particularly, this invention relates to a template which is conformable to the size of the area of the wall to be covered with multiple hangings and carries the locations of the multiple hangings and hook locations onto that area. This invention also relates to a method for arranging two or more wall hangings on the template while the template is lying on a horizontal surface, thereafter transferring the locations of the resulting arrangement, with hook locations for the wall hangings marked on the template, to the vertical surface of the wall, briefly adhering the template to the display area while the hooks for the hangings are fastened through the template into the wall, and then removing the template just before the hangings are placed on the hooks.

BACKGROUND OF THE INVENTION

A variety of devices, methods and systems have been brought forward at various times to facilitate hanging one or more pictures or decorative art works, curios, craft projects and similar types of room enhancements on the walls of rooms at home, in commercial establishments or in public buildings. The difficulties of hanging numerous items in a unified display area have also been described. The present invention provides a simple and expeditious way of solving the earlier problems and even makes the task quite enjoyable and much less tedious for one person to do by himself.

One such prior art system is shown and discussed in U.S. Pat. No. 4,076,612 which issued Dec. 31, 1991. That patent is specifically directed to the problems of locating a variety of rectangularly shaped and oddly shaped objects harmoniously with each other and with other features in the room such as windows, counters, furniture, light fixtures, etc. Textures such as papered or veneered walls are also considered. The difficulties most people have with making up their minds in this endeavor are recognized as well as the difficulty many inexperienced people have with accurately locating places for installing hangers such as hooks, screws and similar attachment devices.

The '612 patent provides a suggestion for meeting these difficulties in the form of an easily releasable, adhesive backed, elongated sheet, long enough to be stored like a roll of wallpaper from which forms shaped like the rectangular and oddly shaped objects to be hung may be cut and then adhesively pressed against the wall in various arrangements. The sheet has holes so that the forms of the objects, i.e., the replicates, will also have holes when they are cut out of the sheet. The holes are surrounded by the releasable adhesive. Fasteners may be inserted through the holes when a suitable place for an individual replicate has been found on the wall among the rest of the shapes already there. Alternatively, if there is no convenient hole through the replicate to accept a fastener, a user is to determine where a fastener for the replicate must be driven into the wall so that the hangers for the object itself will be properly engaged.

Another suggestion for arranging multiple wall hangings on a wall occurs in U.S. Pat. No. 4,933,973, issued Aug. 10, 1999. In that patent a tool is suggested which carries two bubble levels and a rule for arranging the items to be hung directly on the wall in a strictly vertical or strictly horizontal sequence. Such sequences are independent of the wall and ceiling intersection and independent of the wall and sidewall intersection. The problem addressed by the '973 patent is how to avoid misalignment of vertical and horizontal wall hangings which are oriented to nonvertical and nonhorizontal room intersections. The tool which is disclosed utilizes bubble levels which it carries to position the hangings absolutely upright and absolutely horizontal. The tool also utilizes a ruler which it carries to locate nail holes for each hanging in a geometrical or vertical and horizontal manner.

Other suggestions for arranging multiple items on a planar surface have been noted but are not regarded as addressing the same or similar problems as those addressed by the present invention. For example, in U.S. Pat. No. 2,099,845, issued Nov. 23, 1937, a system of stencils and a stencil coordinating spider are proposed for mounting pictures on the pages of an album, and in U.S. Pat. No. 1,544,327, issued Jun. 30, 1925, a stencil is proposed for drawing a plurality of real estate lots on a plot or page. In U.S. Pat. No. 4,132,000, issued Jan. 2, 1979, rifle targets are generated utilizing a clear plastic sheet with graded apertures and locating apertures placed on a target sheet. As the clear plastic sheet is rotated and the locating apertures are turned and reregistered with initial markings on the target sheet, expanding target areas are formed and marked on the target sheet. And in U.S. Pat. No. 4,443,979, issued Apr. 24, 1984, a yard or so long plastic template is suggested for marking fastener positions on the back of a wall hanging and also on a wall at a desirable location. There the same indicia holes which were used to mark the locations for the fastener positions on the back of the wall hanging are used to mark complementary fastener locations on the wall itself.

The present invention approaches the problems of placing a group of wall hangings on a vertical display area of a wall in a very different manner, emphasizing the decorator's visualization of the entire display area in the comfortable environment of a flat horizontal surface which is easily reachable and easily changed or reorganized and yet seen in full perspective. The design thus achieved is readily and exactly transferred to the wall using the template which the decorator created for the entire area.

SUMMARY OF THE INVENTION

The present invention is embodied in a template for transferring an arrangement of at least a pair of wall hangings having fastener means thereon from a horizontally disposed work surface to a vertically disposed display surface on a wall of a room. The template comprises a flexible sheet containing a field portion conformable to the vertically disposed surface, locator indicia on the field portion for recording the longitudinal and latitudinal positions of an outer configuration of each wall hanging, a location for each fastener means associated with each wall hanging, and a location for a hook to engage each fastener means. There is also an inscribable surface on the field portion for accepting a mark recording the location of each wall hanging, fastener means and hook location.

From the foregoing, and from what follows, it will be apparent that the present invention solves numerous problems which decorators and others have had arranging a plurality of wall hangings on a wall in a brief and simple-to-follow way.

It is one of the objects of this invention to provide a flexible sheet on which to outline two or more wall hangings in an arrangement for decorating a wall area.

It is another object of this invention to provide a flexible sheet on which an arrangement of two or more wall hangings may be placed horizontally and then moved to a vertical wall surface without any need for readjustment of the hangings in relation to one another.

It is another object of this invention to provide a flexible sheet on which to make an arrangement of wall hangings covering the size of the display area of a wall.

It is another object of this invention to provide an overlapping and integrateable set of flexible sheets on which to make a unified arrangement of wall hangings for a wall display area which is larger than the size of a single sheet in the set of sheets.

It is another object of this invention to provide a flexible sheet for an arrangement of wall hangings locating the final positions of the hooks for the suspension means of the wall hangings in the display area.

It is a still further object of this invention to provide a flexible sheet on which to make an arrangement of wall hangings which is moveable as a unit without changing the spatial relationship of the hangings in the arrangement to each other.

Other objects and features of this invention will be apparent to those skilled in the interior decorating art from an examination of the following detailed description of preferred embodiments of the invention and of the accompanying drawings.

DESCRIPTION OF THE PREFERRED EMBODIMENTS

The preferred embodiments of this invention shown in the accompanying drawings will now be described, it being understood that the preferred forms are illustrative and that the invention described herein is embodied in the claims which are appended hereto.

Figure 1:
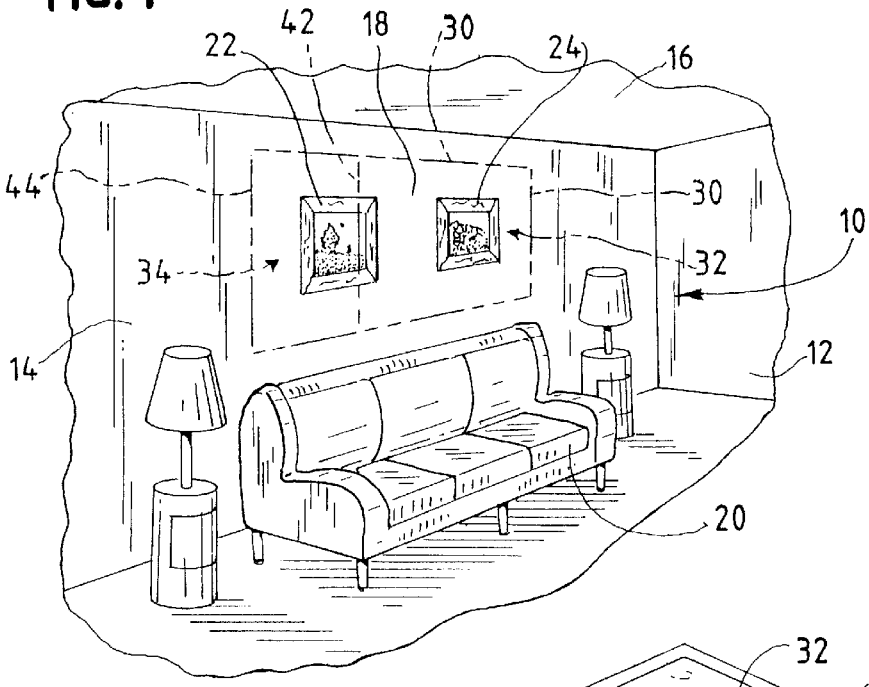
FIG. 1 is a perspective view of a pair of framed pictures hung on a wall of a room showing in dotted lines the former location of a pair of overlapped flexible sheets embodying the present invention.
Figure 6:
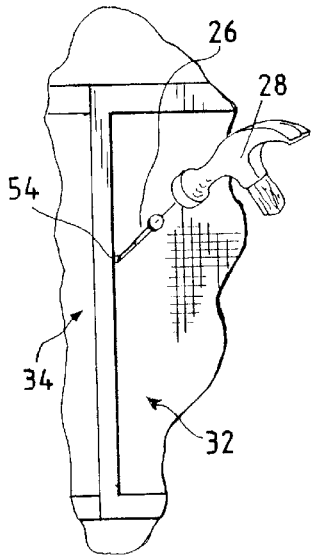
FIG. 6 is an enlarged perspective view of a hook member for the pictures shown in FIG. 4 being installed in the display area of the wall shown in FIG. 1 through the marked zenith location of a picture suspension wire.

A portion of a room 10 with walls 12 and 14 and ceiling 16 is illustrated in FIG. 1. A display area 18 on the wall 14 located above furniture piece 20 incorporates places for a pair of wall hangings such as pictures 22 and 24. Picture 22 is hung on a nail 26 or similar form of hook (See FIG. 6) driven into the display area with a hammer 28 or other tool, which might be a screwdriver if a screw were used instead of nail 26. Wall anchors (not shown) might also be used for receiving a variety of forms of hooks which might be used, any of which would be installed in the display area of wall 14 at points selected in a manner which will shortly be described.

The dotted lines 30 in FIG. 1 surrounding pictures 22 and 24 designate the outlines of the places where templates 32 and 34 (See FIG. 2) were positioned over the display area 18 prior to the pictures being hung. The templates, after being assembled together in a manner which will also be described shortly, and marked with the locations of the hooks for the pictures, were placed over the display area and adhered to the wall briefly while the hooks for the pictures were driven into place. Then the templates were removed from the wall, leaving only the hooks to mark where they had been, and the pictures hung on the hooks.

Figure 2:
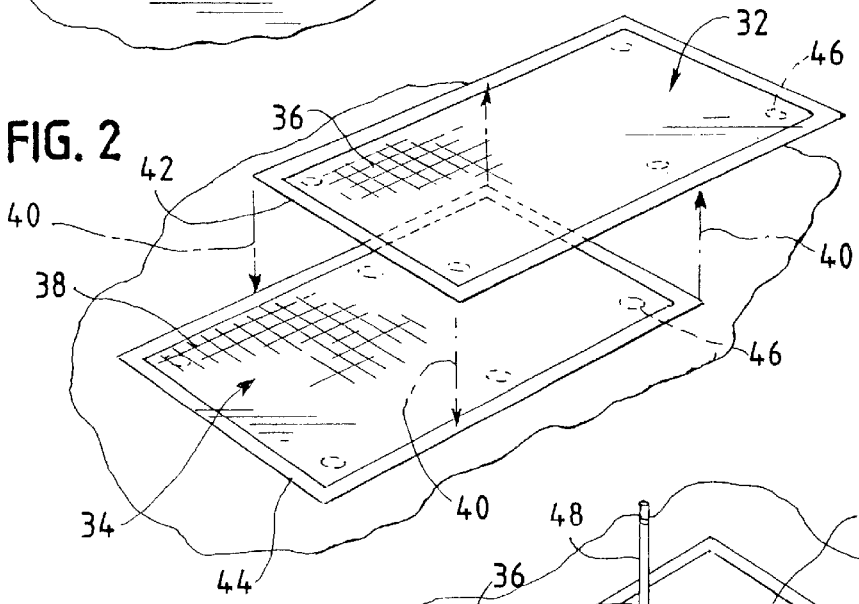
FIG. 2 is an enlarged perspective view of the overlapped, flexible sheets embodying the present invention being arranged in an overlapping, registered manner, in accordance with the grid lines on each sheet, to cover the size of a selected display area of a wall as shown by the dotted lines in FIG. 1.

As shown in FIG. 2, at least two templates, such as 32 and 34 may be assembled together to provide a field large enough to cover a display area such as the display area 18. Preferably, each template is printed or otherwise inscribed with a pattern which can be registered with the same pattern on another template. For illustrative purposes the template 32 is shown as being inscribed with a pattern of grid lines 36. The same pattern of grid lines is inscribed on template 34 as grid 38. Placement arrows 40 illustrate that the left end 42 of template 32 is offset to the right of the left end 44 of template 34, leaving the left end of template 34 uncovered when the template 32 is brought down on top of template 34. The grid patterns 36 and 38 are registered with one another as the templates 32 and 34 are joined, template 32 on top of template 34. The combined grid patterns 36 and 38 are of such a size together that the size of the entire display area 18 is covered by the enlarged grid made up of the combined grids when the templates are placed on the wall.

Small pieces of double-sided pressure sensitive tape 46 may be used to fasten templates 32 and 34 together and also to fasten the combined templates to the wall.

Figure 3:
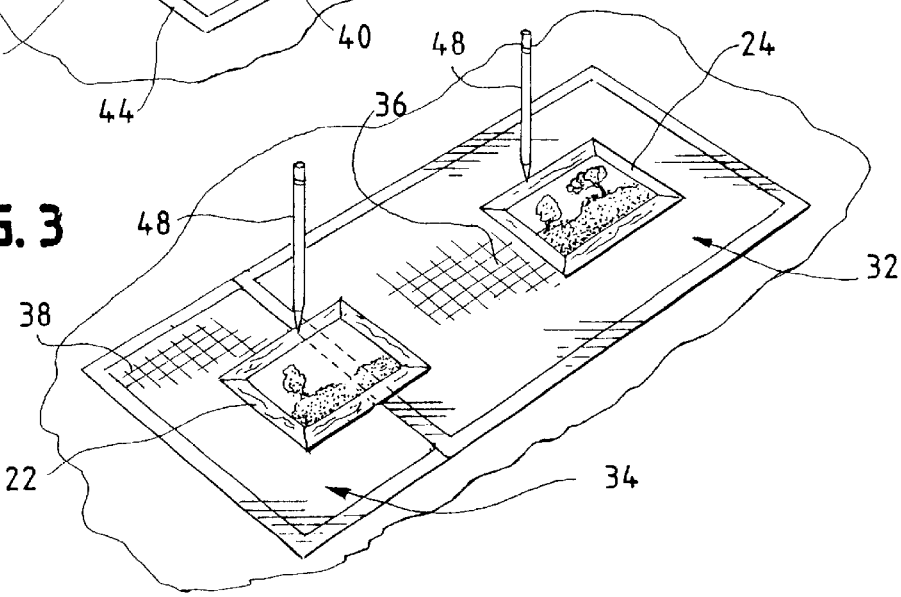
FIG. 3 is a perspective view of the flexible sheets of FIG. 2 subsequent to the registration of those sheets and showing the positioning of the framed pictures shown in FIG. 1 on the sheets and the tracing of their locations on the combination of overlapped flexible sheets of FIG. 2.

The grid patterns 36 and 38 of the preferred template embodiments 32 and 34 assist in aligning the templates and also in balancing design elements when they are placed on the templates such as placing the pictures 22 and 24 in a balanced relation as shown in FIG. 3. Alternatively, other patterns besides a grid may be used for the same purposes, and templates without any pattern at all may be utilized with less convenience although probably promoting more design ingenuity. As shown in FIG. 3, the combined templates 32 and 34 are disposed horizontally, as on a table or a floor, and the pictures 22 and 24 arranged as desired, face up, upon the combined fields of the grids 36 and 38. The upwardly facing surface of each template is inscribable, as with pencils 48, so that the outline of each picture can be placed where the pictures are to appear in a final arrangement on the combined grid fields. Such placement will be transferred to the display area of wall 18 when the templates are moved to the wall from their horizontal location and position.

Figure 4:
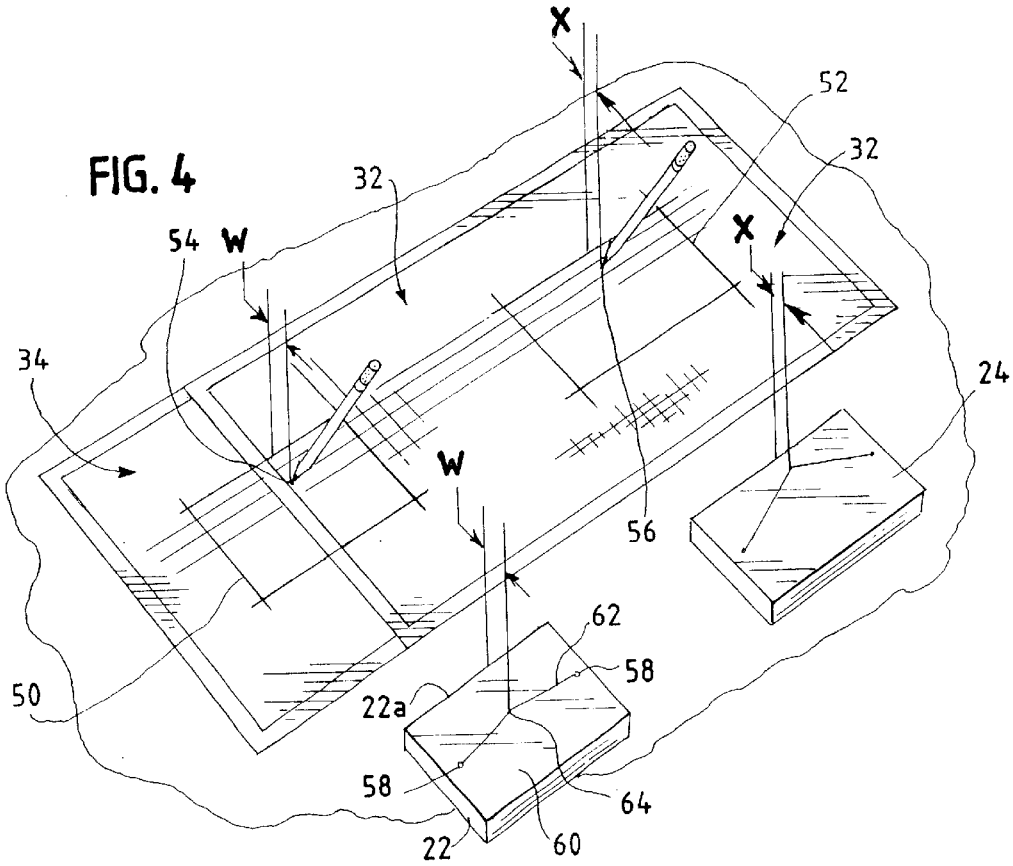
FIG. 4 is a perspective view of the flexible, overlapped sheets of FIGS. 1–3 showing the framed pictures of FIG. 3 turned face down adjacent the flexible sheets and the zenith of a wall-fastening suspension wire on the back of each picture registered by marking on the flexible sheets.

When the outlines of the pictures 22 and 24 have been inscribed on templates 32 and 34, the pictures are lifted from the field, leaving the outlines inscribed thereon, outline 50 for picture 22 on templates 32 and 34, and outline 52 for picture 24 on template 32, as shown in FIG. 4. If the display area of the wall were smaller and only one template were used instead of two to cover it, both of the outlines would be on the same template instead of extending over onto a further template. The locations 54 and 56 of the hooks for engaging the wall fastener mechanisms on the backs of each picture are also inscribed on templates 32 and 34 for transfer to the display area 18 on the wall.

Various methods may be used to determine the locations 54 and 56 for the hooks both longitudinally in relation to the top and bottom of each picture and latitudinally in relation to the sides of each picture. One of those methods is illustrated in FIG. 4. When the pictures 22 and 24 are removed from the templates, they are turned face down in order to measure the distance of the fastener means which each picture carries from the top edges of each picture frame. As shown, picture 22 has a pair of eyelets 58 on its back panel 60. A length of picture wire 62 is connected at each end to the eyelets 58, and at approximately its midpoint 64 between the eyelets all of its slack is eliminated by stretching it to its zenith as close to the top edge 22*a* of the frame of picture 22 as it will go. The distance W between the zenith of picture wire 62 and the top edge 22*a* of the picture frame, namely, at about mid-point of the picture wire, is the point where the hook 26 (See FIG. 6) for picture 22 should engage the picture wire 62. That point is located by measuring where point 64 is longitudinally and latitudinally on the back of picture 22 and correspondingly marked on template 34 as hook location 54. As shown in FIG. 4, the hook location is within the outline 50 of picture 22 on templates 32 and 34, although the zenith of stretched picture wire 62 is the determinant, and the hook location 54 to match it is recorded on templates 32 or 34 wherever the zenith of the stretched wire causes point 64 to materialize.

Hook location 56 for picture 24 may be recorded on template 32 in the same manner as just described for locating hook location 54 for picture 22. Other methods may be used for determining the locations of the hooks, including the recording of hook locations without measuring the fastener means on the wall hangings in any way or in a different way from the method just described. The template or templates very effectively transfer the recorded hook locations to the display area of the wall no matter how the manner of making the record of the hook locations is determined.

Figure 5:
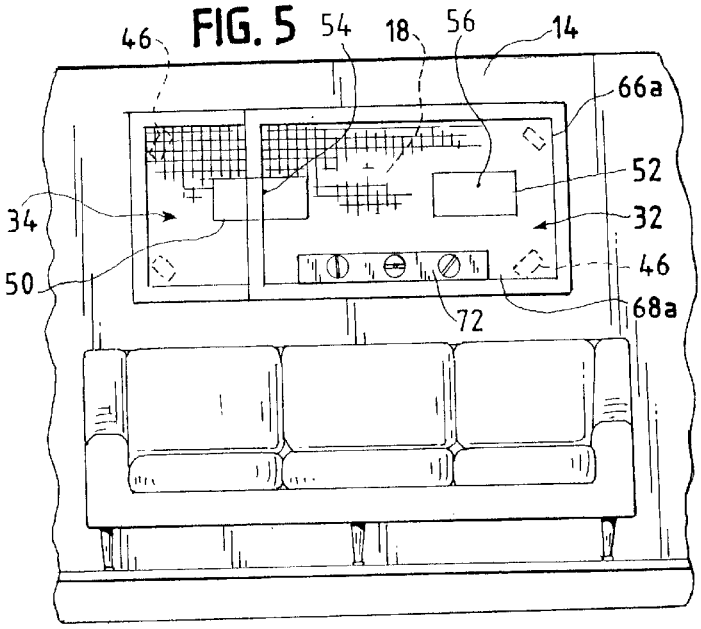
FIG. 5 is an elevational view of the flexible, overlapped sheets of FIG. 4 mounted on the display area of the wall shown in FIG. 1 with a leveling device arranged along the lower edge of the overlapped sheets for leveling the horizontal lines of the grid on the sheets and showing the marked locations on the flexible sheets of the apexes of the suspension wires on the backs of the pictures shown in FIG. 4.
Figure 7:
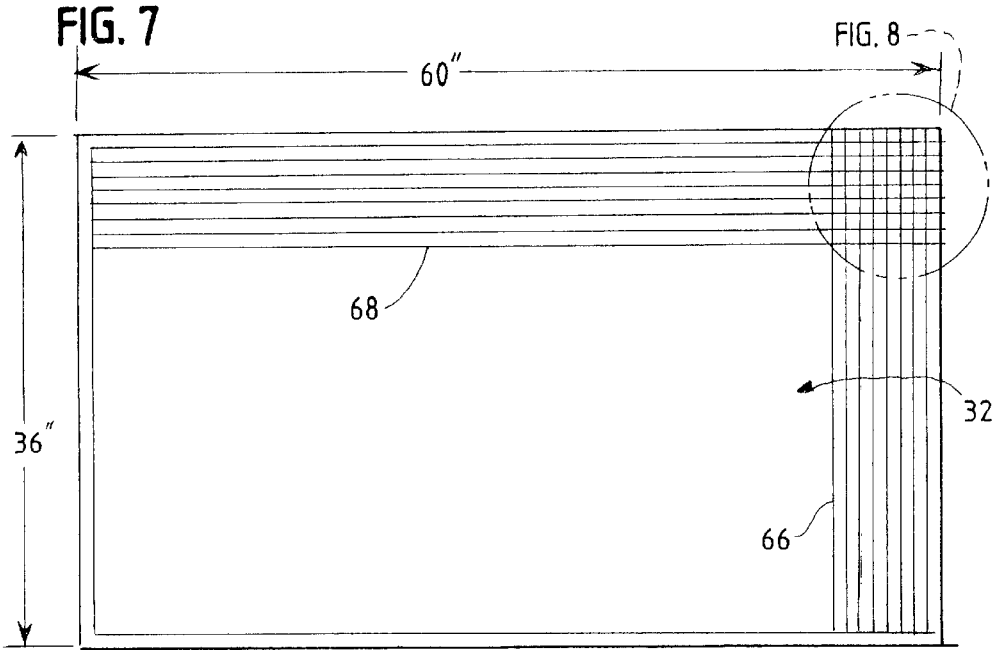
FIG. 7 is a plan view of one of the flexible sheets of this invention shown in FIG. 1.
Figure 8:
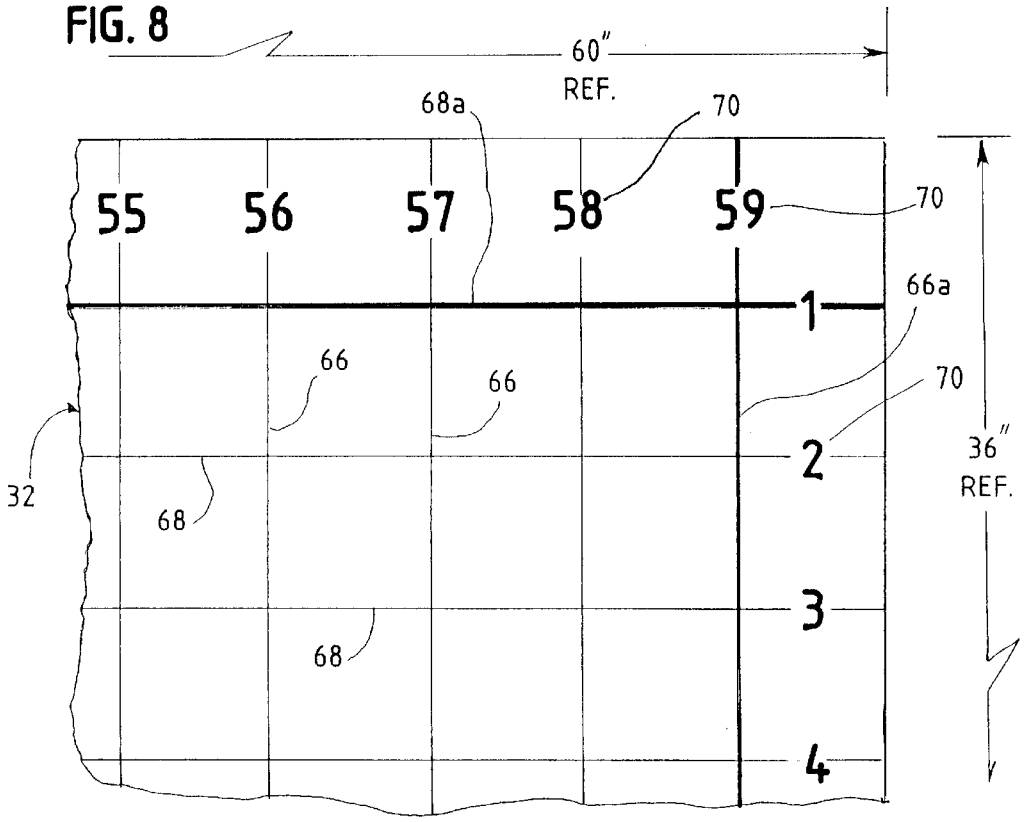
FIG. 8 is an enlarged plan view of a portion of the flexible sheet of this invention shown in FIG. 7.

Moving the templates from the horizontal position, where the arrangement of the hangings and the locations of the hooks were determined and the templates completed with markings, to the display area of the wall has been referred to previously. Further elements which may be added to the templates are illustrated in FIGS. 5, 7 and 8. It has been found that a convenient size for a template sheet is sixty inches long by thirty-six inches high and that ruling a template sheet of that size into one-inch squares is helpful in visualizing and recording arrangements of wall hangings. The field covered by the rulings can be increased by registering the rulings of one template with the rulings in an identical template except that the edges of the sheets are offset. Thus, as shown in FIGS. 7 and 8, vertical rulings 66 are applied to the template 32 and spaced one inch apart from each other. Similarly, horizontal rulings 68 on template 32 are spaced one inch apart from each other. So oriented, the rulings 66 and 68 form grid pattern 36 (See FIG. 2). An identical grid pattern 38 of vertical and horizontal rulings formed on template 34 provides a mating means for registering templates 32 and 34 with one another and increasing the size of the field covered by the grid patterns 36 and 38 together.

The addition of identifying numbers 70 for the vertical and horizontal rulings in the grid pattern, especially when the identifying numbers specify vertical and horizontal lines which are one inch apart, aids in matching the size of the field covered by the grid pattern with the size of the display area of the wall to be covered. Thus, if the size of the display area is greater than sixty inches long and thirty-six inches high, more than one template may be used and the templates offset from each other at their edges as previously described.

It is also helpful in moving a template embodying the present invention from its horizontal position, when the arrangement of the hangings is being completed, to have a reference grid on the face of the template in order to make sure that the template is level when it is horizontally aligned on the wall. Accordingly, the vertical rulings 66*a* and the horizontal rulings 68*a* adjacent the edges of each template may be printed as heavier, darker lines than the other rulings on the template. As shown in FIG. 5, a level 72 may be placed along horizontal line 68*a* near the bottom of the templates 32 and 34 before the adhesive patches 46 are pressed against the display area 18 on wall 14. The arrangement of pictures marked on the templates at 50, 52 will be correspondingly leveled when the horizontal ruling 68*a* is leveled and the hook locations for the hangings will be disposed in the display area as the decorator intended.

The template or group of templates described above is useful in transferring an arrangement of at least a pair of wall hangings, each of which has a fastener mechanism on its back side such as a length of picture wire, from a horizontally disposed work surface to a vertically disposed display surface on a wall of a room. The method of making such a transfer includes conforming the template (or group of templates) to cover the size of a display surface on the wall of a room, placing the template on a horizontally disposed work surface, arranging the wall hangings into a group on the template within the size of the display surface, locating each place on the template for hooks to engage the fastener mechanisms on the backs of all of the wall hangings in the group and marking the places on the template for the hooks, applying the template to the display surface on the wall, fastening the hooks into the display surface through the template at the places marked for them on the template, removing the template from the wall display area, and hanging the wall hangings on the hooks in the same relationship to each other as they were when they were assembled horizontally.

From all of the foregoing it will be evident that, although a particular form of the invention has been illustrated and described, nevertheless various modifications can be made without departing from the true spirit and scope of the invention. Accordingly, no limitation on the invention is intended by the foregoing description, and its full breadth is intended to be covered in the following claims.

I claim:

1. A template for transferring an arrangement of at least a pair of wall hangings having fastener means thereon from a horizontally disposed work surface to a vertically disposed display surface on a wall of a room comprising:

a flexible sheet containing a field portion conformable to the vertically disposed display surface, locator indicia on the field portion for recording the longitudinal and latitudinal positions of an outer configuration of each wall hanging, a location for each fastener means associated with each wall hanging, and a location for a hook to engage each fastener means, an inscribable surface on the field portion for accepting marks recording the location of each wall hanging configuration, wall hanging fastener means and hook location, and at least a pair of wall hanging locations in the arrangement fixed on the inscribable surface in relation to each other.

2. The template of claim 1 which includes a registration member for orienting the template on the vertically disposed display surface.

3. The template of claim 2 in which the registration member is a straight edge portion positionable in parallel with a junction of the wall containing the vertically disposed display surface and another wall or ceiling surface of the room.

4. The template of claim 2 in which the registration member is a line formed along a border of the field portion of the template.

5. The template of claim 1 in which the flexible sheet is a sheet of paper.

6. The template of claim 1 in which the flexible sheet is a fabric or film.

7. The template of claim 1 which includes an adhesive member on one side of the flexible sheet for adhering the sheet to the wall containing the vertically disposed display surface.

8. The template of claim 7 in which the adhesive member is composed of a plurality of adhesive segments variously positioned on one side of the flexible sheet.

9. The template of claim 8 in which the adhesive segments are double-sided pressure sensitive adhesive pads.

10. The template of claim 1 in which the locator indicia are formed by a grid of vertical and horizontal lines.

11. The template of claim 1 in which the locator indicia are formed by a plurality of markings spaced apart from each other.

12. The template of claim 1 in which the locator indicia are registerable with matching locator indicia on a duplicate template and form an expanded field portion when the templates are registered and offset from each other.

13. The method of transferring an arrangement of at least a pair of wall hangings having fastener means thereon from a horizontally disposed work surface to a vertically disposed display surface on a wall of a room comprising the steps of:

conforming the size of the flexible sheet of material to the size of the display surface for the hangings on the wall of the room, placing the flexible sheet on a horizontally disposed work surface, arranging the wall hangings on the flexible sheet within the size of the display surface, locating each place on the flexible sheet for hooks to engage the fastener means on each wall hanging, applying the flexible sheet to the display surface on the wall of the room, engaging the hook for each fastener means into the display surface at the places located on the flexible sheet, and removing the flexible sheet from the display surface.

14. The method of claim 13 which includes the step of establishing outlines on the flexible sheet around the wall hangings prior to locating the places on the sheet for the hooks.

15. The method of claim 14 which includes the step of locating the places for the hooks within the outlines of the wall hangings prior to applying the flexible sheet to the display surface.

16. The method of claim 15 which includes the step of engaging the wall hangings on the hooks in the display surface in the same relationship to each other as shown by the outlines of the hangings and the locations of the hooks on the flexible sheet.

* * * * *